US010055918B2

(12) United States Patent
Schroader et al.

(10) Patent No.: US 10,055,918 B2
(45) Date of Patent: Aug. 21, 2018

(54) SYSTEM AND METHOD FOR PROVIDING SECURE AND ANONYMOUS PERSONAL VAULTS

(71) Applicant: SafeHarbor, Inc., Round Rock, TX (US)

(72) Inventors: Russell Schroader, Round Rock, TX (US); Robert Schroader, Draper, UT (US)

(73) Assignee: SafeHarbor, Inc., Round Rock, TX (US)

( * ) Notice: Subject to any disclaimer, the term of this patent is extended or adjusted under 35 U.S.C. 154(b) by 0 days.

(21) Appl. No.: 15/233,889

(22) Filed: Aug. 10, 2016

(65) Prior Publication Data

US 2017/0046896 A1 Feb. 16, 2017

Related U.S. Application Data

(60) Provisional application No. 62/203,353, filed on Aug. 10, 2015.

(51) Int. Cl.
*G07C 9/00* (2006.01)

(52) U.S. Cl.
CPC ..... *G07C 9/00166* (2013.01); *G07C 9/00158* (2013.01); *G07C 9/00912* (2013.01)

(58) Field of Classification Search
CPC ..... G07C 9/00166; G07C 9/00158; G07C 9/00912; G07C 9/00563; G07C 9/00087; G07C 9/00658; H04L 63/102; H04L 63/107; H04L 63/0861; H04L 67/42; G08B 13/08
USPC ..... 340/5.73; 235/382
See application file for complete search history.

(56) References Cited

U.S. PATENT DOCUMENTS 7,497,376 B2 * 3/2009 Landwirth ..... G07C 9/00912 235/379

* cited by examiner

*Primary Examiner* — Ali Neyzari
(74) *Attorney, Agent, or Firm* — Mintz Levin Cohn Ferris Glovsky and Popeo, P.C.

(57) ABSTRACT

A method and system for providing a secure vault may include providing a vault enclosure that has one or more nests, with each nest including one or more personal vaults. The personal vaults can also be used as a secure and anonymous gun locker. Security information must be established before access is granted to the vault enclosure, a nest, and a personal vault. Separate access measures are required for access to the vault area, the nest, and the personal vaults. User anonymity can be maintained by only linking security information to a particular nest and personal vault, without requiring any personal identifying information from the user.

20 Claims, 12 Drawing Sheets

SYSTEM AND METHOD FOR PROVIDING SECURE AND ANONYMOUS PERSONAL VAULTS

CROSS-REFERENCE TO RELATED APPLICATIONS

The current application is related to/claims priority under 35 U.S.C. § 119(e) to U.S. Provisional Patent Application No. 62/033,353, filed Aug. 10, 2015, the contents of which are hereby incorporated by reference in its entirety.

TECHNICAL FIELD

The subject matter described herein relates to providing secure and anonymous personal vaults.

BACKGROUND

Users can store valuables or other items in safe-deposit boxes, for example, the type typically available at banks. Similar storage areas may also be located in other facilities such as locker clusters, subway stations, train stations, or the like.

SUMMARY

In one aspect, a method includes receiving, at a server, security information from a terminal interface in a vault enclosure. The vault enclosure has a vault area containing nests with nest doors that allow access to a personal vault that has a personal vault door.

A barrier to the vault area is unlocked in response to receiving a first command from the server when the received security information matches stored security information at the server. The server determines a nest door associated with the user based on a comparison between the security information and a record stored at the server. The nest door allowing access to the personal vault is unlocked in response to a second command received from the server, while maintaining a locked status on other nest doors of the plurality of nests that are not associated with the user.

In some variations one or more of the following features can optionally be included in any feasible combination.

The server can detect a user in an entrance area based on monitoring data transmitted from a monitoring device configured to monitor the entrance area. The server can determine that the user passes visual verification based on a comparison between the monitoring data and the security information stored at the server. The unlocking of the barrier can be performed based on the user passing visual verification.

The server can detect a user in the vault area based on second monitoring data transmitted from a second monitoring device configured to monitor the vault area. The server can receive a confirmation that the user is the only user in the vault area. The nest door can be unlocked based on the received confirmation.

The server can compare the second monitoring data to a known profile of the user to confirm a user identity. The second monitoring data can include at least one of photographs, still images, or video from the second monitoring device. The second unlocking can be performed when the user identity is confirmed.

The server can receive a status for each personal vault and each nest, the status indicating whether the personal vault is locked or unlocked. The first unlocking can be performed only when the status of each personal vault is locked and each nest is locked.

The security information can include a facial recognition scan, a fingerprint scan, or a voiceprint scan.

The first unlocking or the second unlocking can be based on the server identifying an association between an anonymous user and the personal vault associated with the anonymous user, but does not identify the anonymous user. The identification can be based on the security information that does not include personal identifying information for the anonymous user.

An external monitoring device can monitor a terminal area for users other than the user. An alert device can be activated in the vault area or in the terminal area when the monitoring device detects users in the terminal area.

In an interrelated aspect, a vault enclosure includes a vault area with nests having nest doors allowing access to a personal vault with a personal vault door. The nest door has a nest lock connected by a network connection to a server controlling the locking and unlocking of the nest lock.

The vault enclosure also includes a terminal area with a registration terminal and a barrier. The registration terminal is connected by the network connection to the server and configured to receive security information from a user and transmit the security information to the server. The barrier is between the terminal area and the vault area. The barrier has a barrier lock connected by the network connection to the server controlling the locking and unlocking of the barrier lock. There is also a monitoring device in the terminal area configured to monitor the terminal area and transmit monitoring data to the server.

In some variations one or more of the following features can optionally be included in any feasible combination.

Each of the plurality of nests can include a group of personal vaults and each personal vault can be accessed by at most one nest door. The vault enclosure can be an isolated structure that has no walls, floors, or ceilings in contact with another building. Also, the vault enclosure can be surrounded by the terminal area.

DESCRIPTION OF DRAWINGS

These and other aspects will now be described in detail with reference to the following drawings.

DETAILED DESCRIPTION

The details of one or more variations of the subject matter described herein are set forth in the accompanying drawings and the description below. Other features and advantages of the subject matter described herein will be apparent from the description and drawings. While certain features of the currently disclosed subject matter may be described for illustrative purposes in relation to providing anonymous and secure personal vaults, it should be readily understood that such features are not intended to be limiting.

The present application describes implementations that include allowing a user to register for use of a personal vault. The personal vault is contained in a vault enclosure which employs a multi-tiered security solution. A user can securely and anonymously register for and access their personal vault. The security features of the personal vaults and associated facilities can include live remote monitoring by personnel maintaining the personal vaults.

Figure 1:
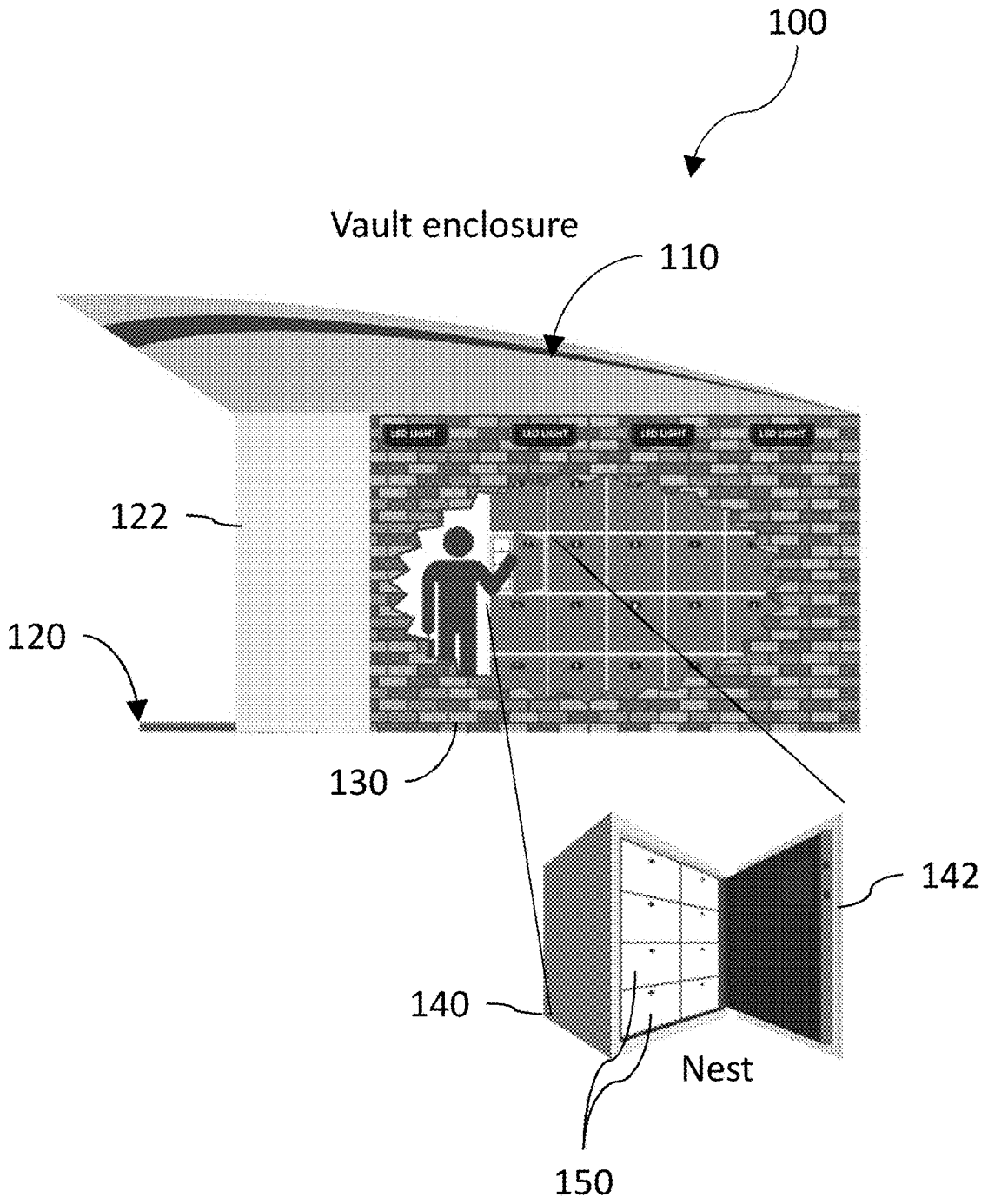
FIG. 1 is a diagram of an exemplary implementation illustrating a vault enclosure.

FIG. 1 is a diagram 100 of an exemplary implementation illustrating a vault enclosure 110. In one implementation, there can be a vault enclosure 110 which contains any number of personal vaults 150. The vault enclosure 110 can be a standalone structure, or integrated into a pre-existing structure. For example, the vault enclosure 110 can be a building in a parking lot, part of the dedicated storefront, integrated into an existing business such as a bank, part of or located at a private residence, on a vehicle, or the like.

As shown in the exemplary implementation of FIG. 1 (and FIG. 8), the vault enclosure 110 can be a stand-alone structure. The definition of a stand-alone structure, as used herein with regard to the vault enclosure 110, can include an isolated structure that has, for example, no walls floors or ceilings in contact with another building. In another implementation, a stand-alone vault enclosure 110 can be one in which the vault enclosure 110 shares a reduced number of walls with other structures. For example, the vault enclosure 110 can be at least partially surrounded by an open space, such as a parking lot, shopping mall, or the like. In these implementations, a number of additional security features can be included. The security features can include, for example, barricades, bollards, increased visibility by the public or law enforcement, cameras that can view all sides of the structure, increased protection from fires or other hazards that might befall nearby buildings, or the like. These and additional security features are further described in the discussion of FIG. 8.

The vault enclosure 110 can have any number of subdivisions. Each of the subdivisions can be separated by one or more barriers or walls each requiring the user to have the proper access to move from one subdivision to another. As shown in the exemplary implementation in FIG. 1, there can be a terminal area 120 and a vault area 130. The terminal area 120 can contain, for example, a registration terminal. In another implementation, the registration terminal can be outside the terminal area 120. The terminal area can also include an entrance area 122. The entrance area 122 can be a lobby or waiting area that can be wholly or partially enclosed. Though not shown in FIG. 1, the registration terminal is further described in FIG. 4. The terminal area 120 can be, for example, open to the public, have access limited to certain times of day, require an approved account, or the like. There can be a barrier between the terminal area 120 and the vault area 130. The barrier can have a barrier lock connected by a network connection to a server of the vault management system controlling the locking and unlocking of the barrier lock.

The vault area 130 of the vault enclosure 110 can include one or more nests 140 each containing one or more personal vaults 150. The nests 140, as shown in FIG. 1, are described in greater detail in FIGS. 2*a-d*. By requiring a user to have proper access not only from the terminal area 120 to the vault area 130, but also to the nest 140, the security of the user's personal vault 150 is enhanced. The nests 140 prevent a user from having access to all personal vaults 150, instead limiting that access to the nest 140. Each nest 140 has a nest door 142 having a nest lock. The personal vaults 150 can only be accessed by opening the nest door 142 of the next 140 associated with that particular personal vault 150. For example, if there are six personal vaults 150 in a nest, a user would only potentially have access to the six personal vaults 150 in his or her nest 140. The user could not access any other personal vaults 150 as those personal vaults 150 would remain secure. Accordingly, a nefarious user, desiring illicit access to another's personal vault 150, could not simply register his or her own personal vault 150 to obtain access to the other personal vault—as it would be most likely the new user would not be in the same nest 140 as the other user's personal vault 150. In one implementation, the nests 140 or any other internal components can be prefabricated such that the system can be prebuilt and then inserted into a new location. With such a modularized construction, the entire system can be generated in as little as two weeks by just constructing the outside structure. The nest lock can be connected by a network connection to a server of the vault management system controlling the locking and unlocking of the nest lock.

Figure 2A:
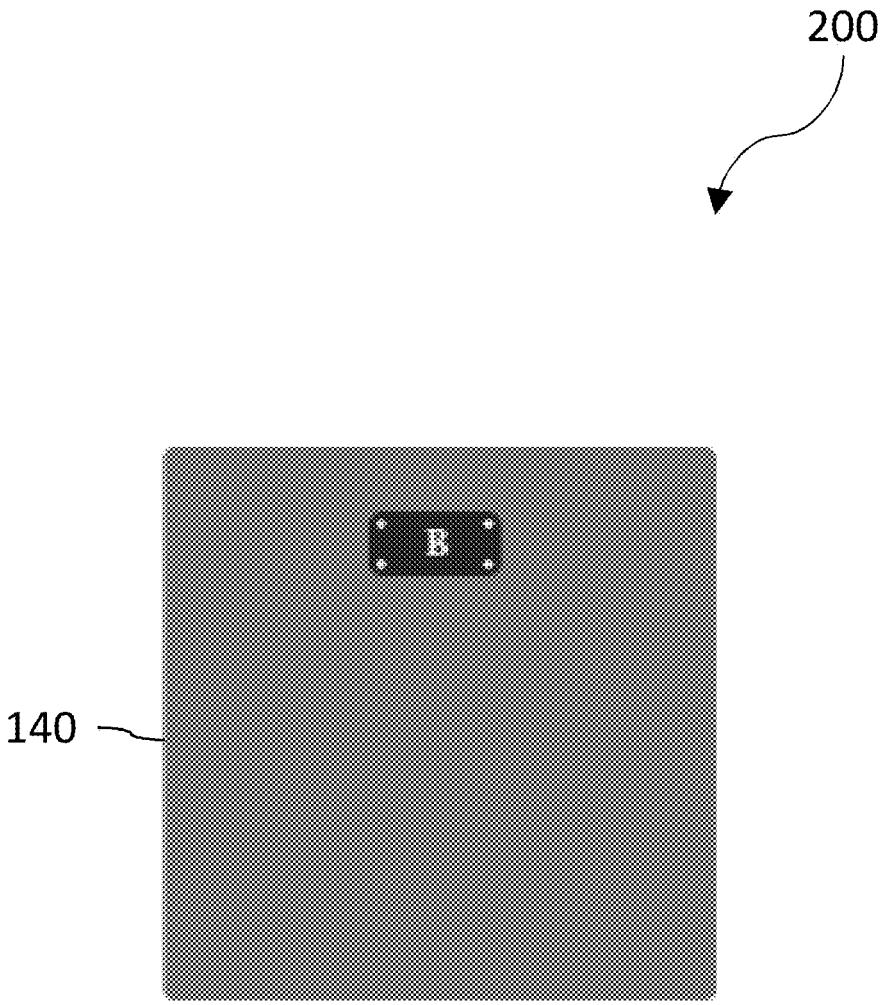
FIG. 2*a* is a front elevational view of an exemplary implementation of a nest in a closed position.
Figure 2B:
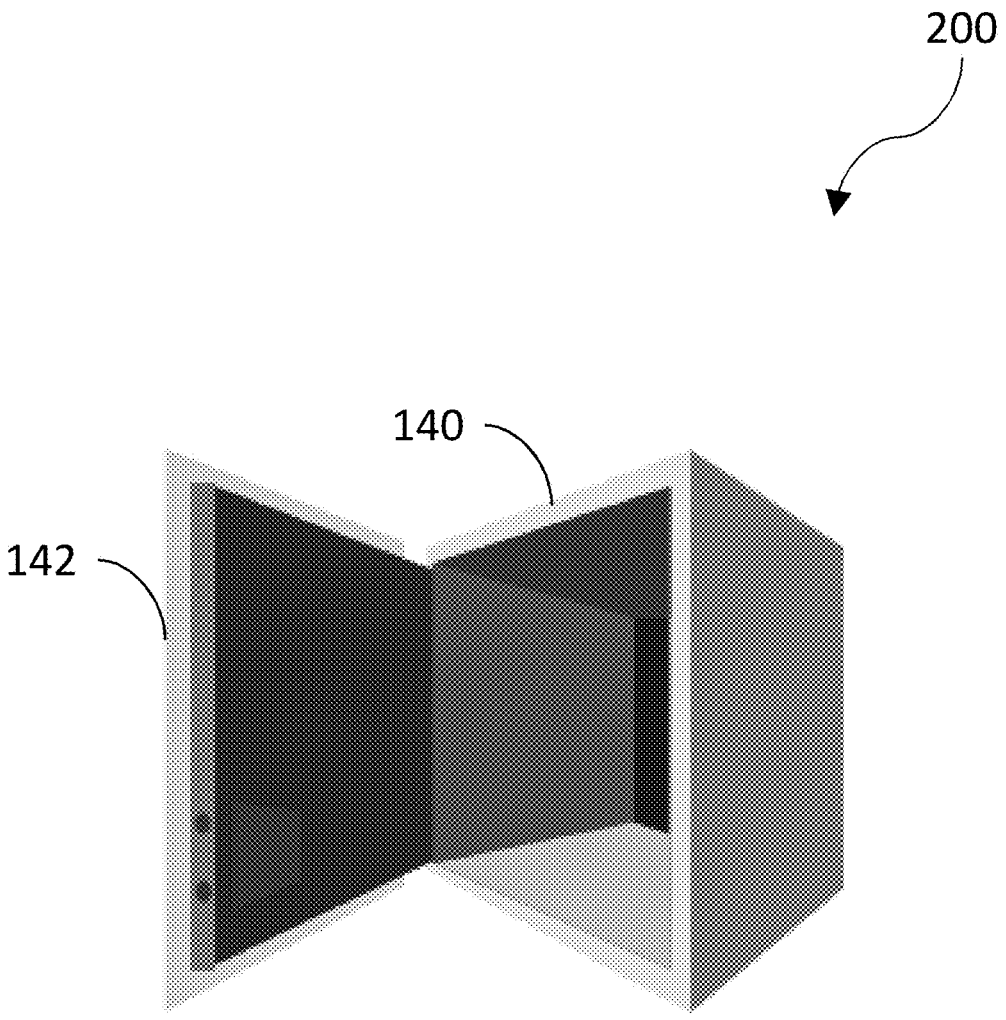
FIG. 2*b* is a perspective view of an exemplary implementation of a nest with a nest door unlocked and in an open position.
Figure 2C:
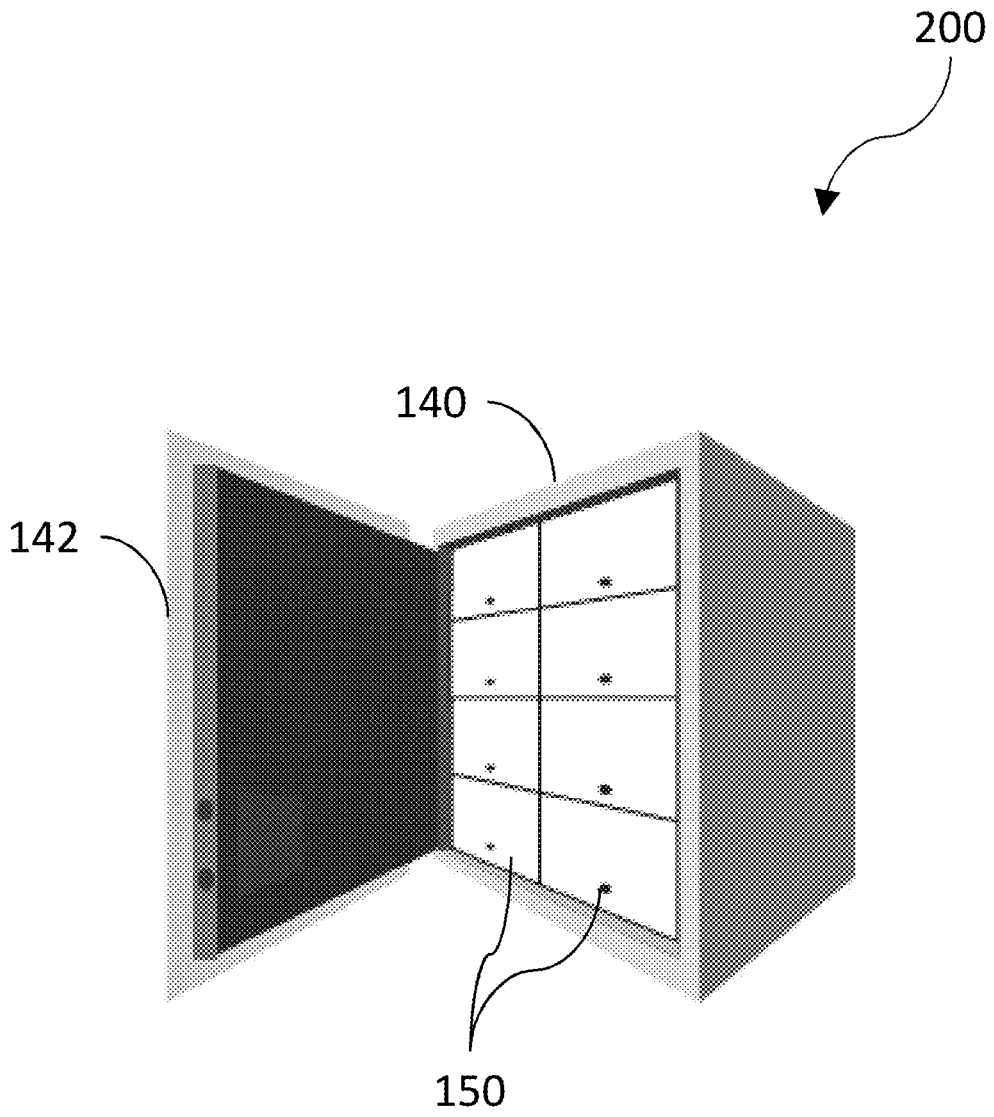
FIG. 2*c* is a perspective view of an exemplary implementation of a nest containing eight personal vaults.
Figure 2D:
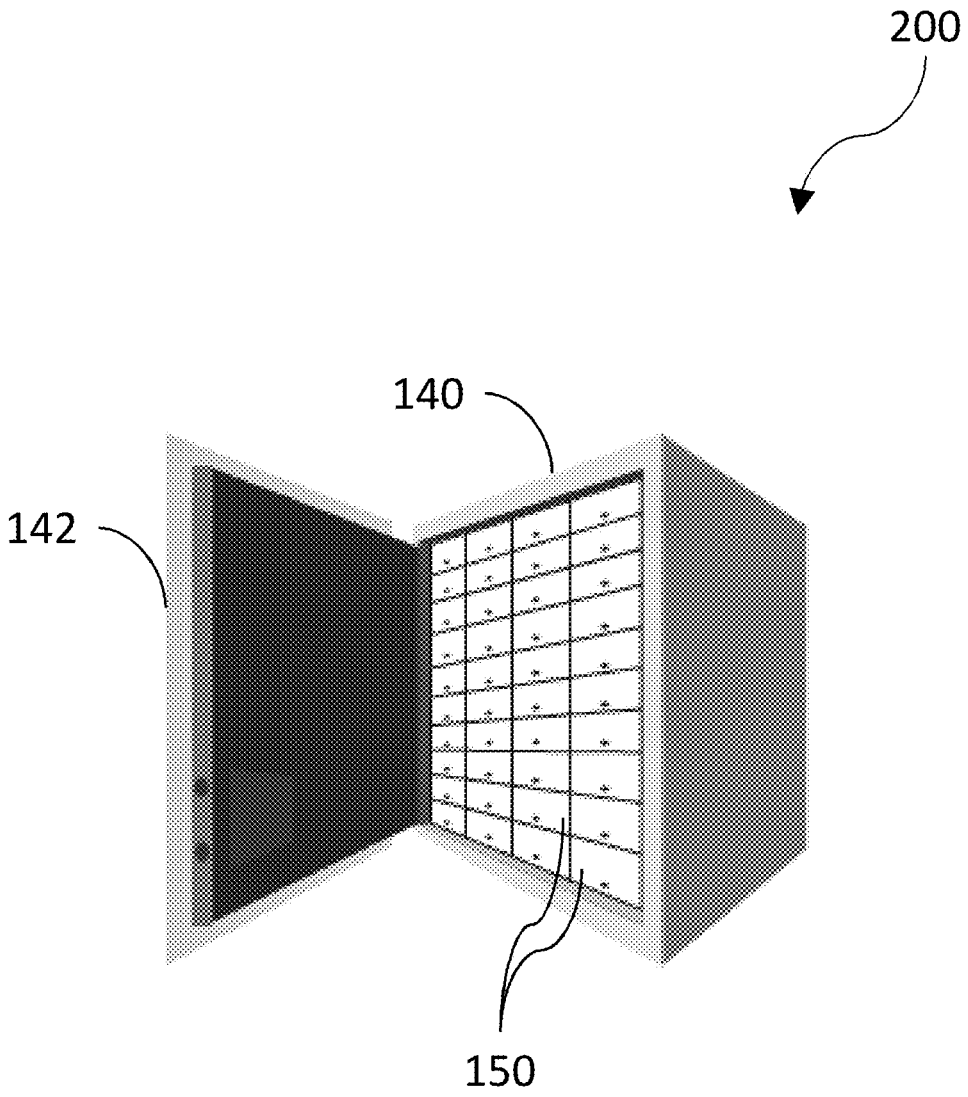
FIG. 2*d* is a perspective view of an exemplary implementation of a nest containing forty personal vaults.

FIG. 2*a* is a front elevational view of an exemplary implementation of a nest 140 in a closed position. FIG. 2*b* is a perspective view of an exemplary implementation of a nest 140 with the nest door 142 unlocked and in an open position. FIG. 2*c* is a perspective view of an exemplary implementation of a nest 140 containing eight personal vaults 150. FIG. 2*d* is a perspective view of an exemplary implementation of a nest 140 containing forty personal vaults 150. As described above, each nest 140 can include any number of personal vaults 150, such as between 5 and 10, 10 or less, between 2 and 8, 10 to 15, and the like. FIG. 2*a* illustrates the nest 140 in a closed position. FIG. 2*b* illustrates a nest 140 with no personal vaults 150 contained therein. Depending on the size of the personal vaults 150, a varying number can be contained within a given nest 140. For example, as shown in FIG. 2*c* and FIG. 2*d*, there are eight and forty personal vaults 150, respectively, in the illustrated nest 140. The number and disposition of the personal vaults 150 in the nest 140 as shown is not intended to be limiting. For example, by changing the size of the nests 140 and the personal vaults 150 the number of personal vaults 150 in each nest 140 can vary.

Figure 3:
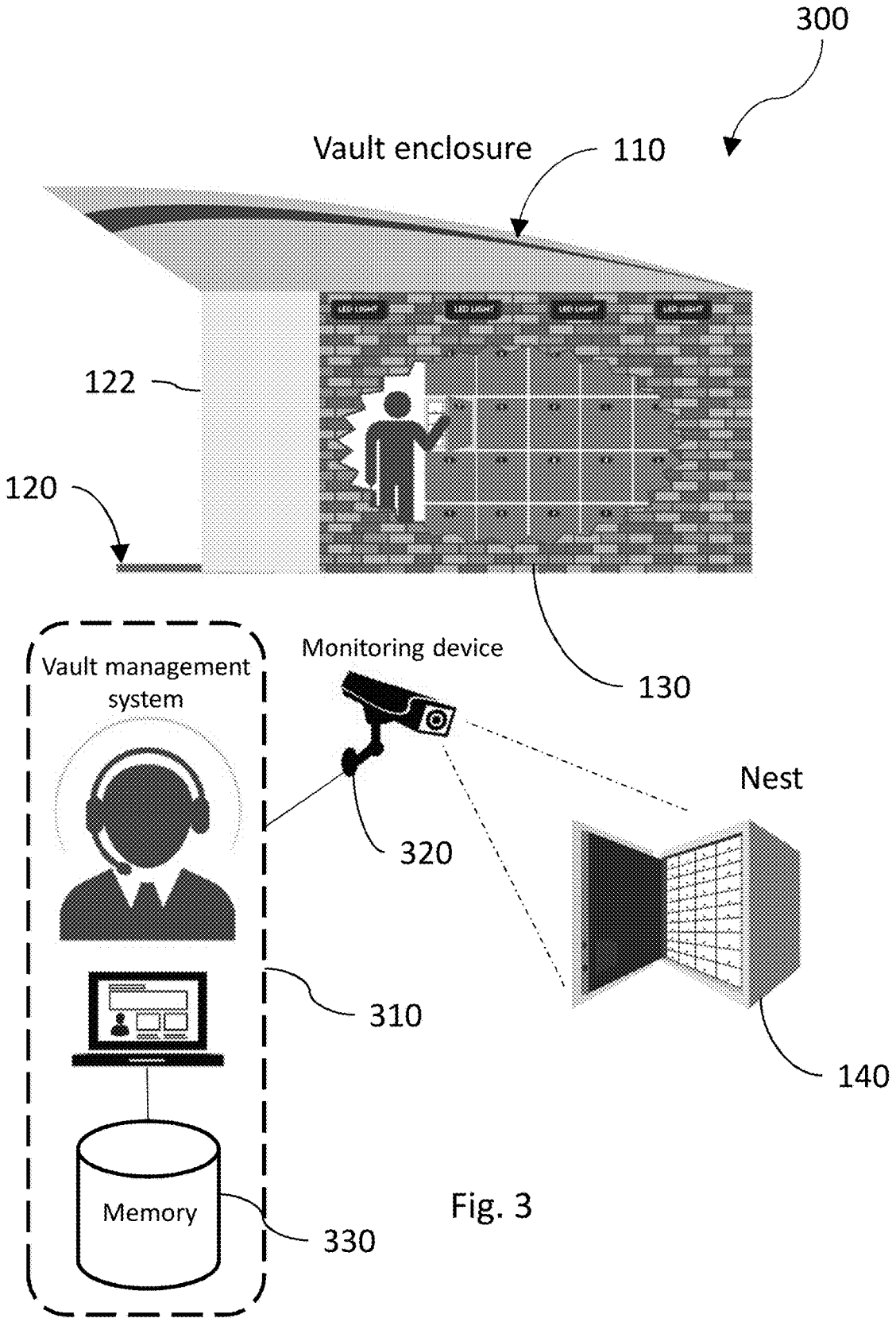
FIG. 3 is a diagram illustrating the nest being monitored by a vault management system.

FIG. 3 is a diagram 300 illustrating a nest being monitored by a vault management system 310. The vault management system 310 can include one or more distributed computing systems or servers and can also include dedicated personnel to monitor either recorded or real-time images or other data relating to occupants of the vault area 130. The vault management system 310 can also include image recognition, pattern recognition, or other forms of artificial intelligence used in conjunction with live or recorded images. Computer programs that are part of the vault management system 310 can be used, for example, to differentiate between persons and other moving objects, such as vehicles, to identify or verify the identity of a person, to confirm that a person is not carrying equipment which could be used to improperly access one or more personal vaults 150, or the like.

One feature of security that can be present in the described system as shown in FIG. 3 is a user being monitored while accessing a personal vault 150. There can be one or more monitoring devices 320 present in the vault area 130 and/or the terminal area 120 to detect and monitor the presence of a user. Examples of monitoring devices 320 can include, for example, closed circuit television cameras, microphones, infrared sensors, high resolution cameras for facial recognition, pressure sensors, vibration sensors, or the like.

The monitoring devices 320 can be connected to the vault management system 310. The connection can be over a wired or wireless network, for example, LAN, WLAN, WI-FI, BLUETOOTH, or the like. There can be additional monitoring devices 320 that can be used for functions besides providing security. For example, there can be an isolated monitoring device 320 as part of the vault management system 310 to provide two-way customer support and/or assistance to users in the terminal area 120 and/or the vault area 130. In some implementations, a customer can speak with a live person with a push of a button. For example, there can be an intercom, one or two way audio/video feed, a terminal for questions or problems to be entered, or the like.

Data, including video feeds, audio feeds, sensor data, security information, access logs, and administrative information can be stored in a memory 330 operatively connected to the vault management system 310. The memory 330 can be, for example, a database, hard drive, flash drive, videotape, audiotape, cloud storage, or the like.

Figure 4:
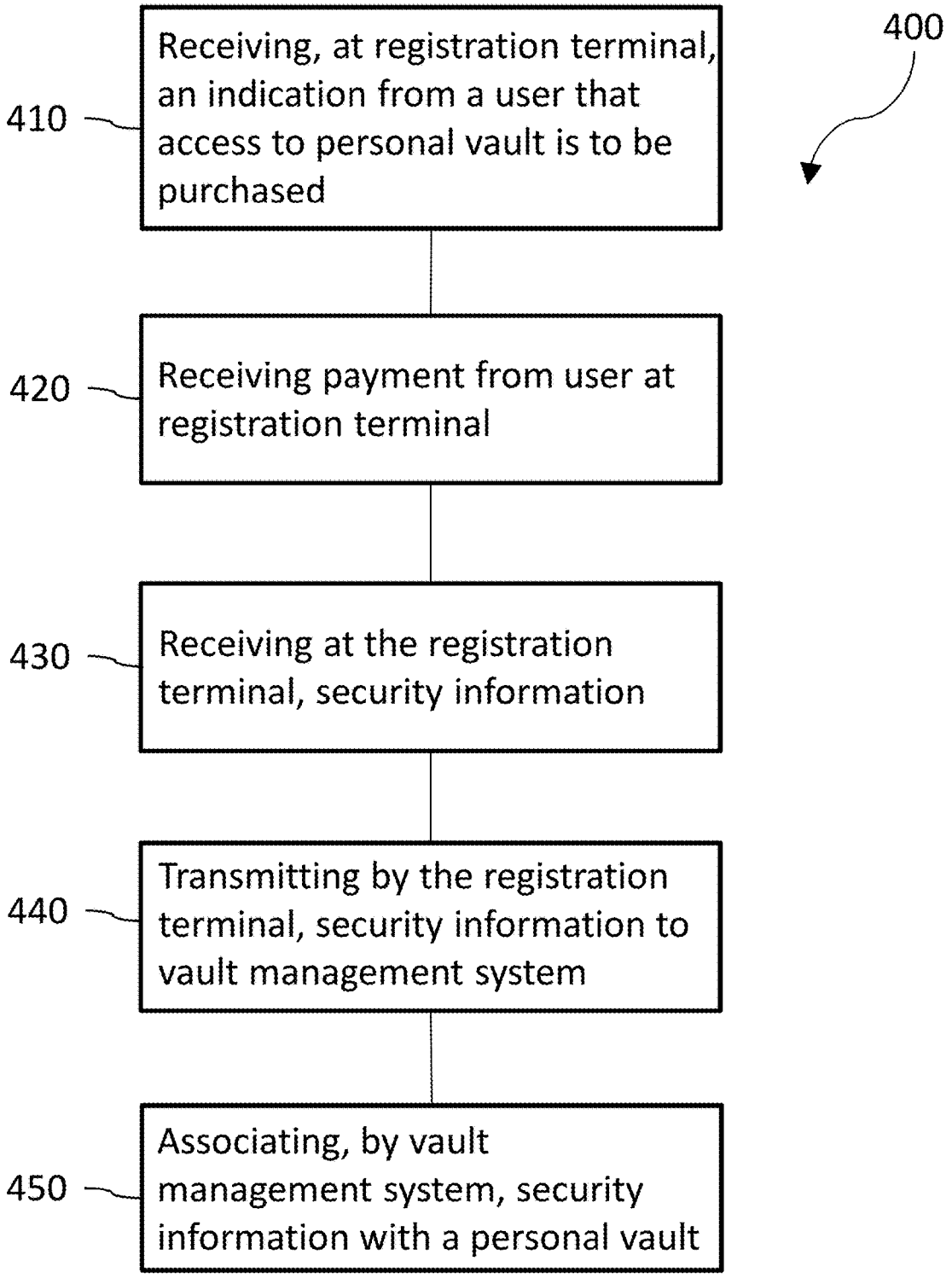
FIG. 4 is a process flow diagram illustrating a user acquiring anonymous access to a personal vault.

FIG. 4 is a process flow diagram 400 illustrating a user acquiring anonymous access to a personal vault 150. In some implementations the identity of a user is kept anonymous even from the vault management system 310. In one exemplary implementation, at 410, a registration terminal can receive an indication from a user that access to a personal vault 150 is to be obtained. The registration terminal can be, for example, a kiosk, a computer terminal, a keypad touchscreen, a graphical user interface displayed on a display device, or the like. The indication can be, for example, sequential entries on a keypad, information received by the execution of the computer program implemented on the registration terminal, voice commands, reading of a card or receipt indicative of an ownership, or the like.

At 420, payment can be received from the user at the registration terminal. Payment can include acceptance of cash, credit cards, debit cards, tokens, or the like. In another implementation, proof of prepayment can be used in place of, or in addition to, payments made at the time of use. In the case of a user that wishes to remain anonymous, a cash payment can be received at the same time as security information, for example a biometric scan or a user-selected PIN code or password.

At 430, security information can be received at the registration terminal. Security information can include, for example, an alphanumeric code, biometric scan, or the like. Examples of the biometric scan that can be included as part of the security information can be, for example, a fingerprint scan, a palm print scan, a facial recognition scan, a retinal scan, a voice print scan, or the like. In one implementation, only the alphanumeric code and the biometric scan are provided by the user. In this implementation, no further identifying information such as name, Social Security number, driver's license number, or the like, are provided by the user. In other implementations, security information can be received through, for example, a terminal separate from the registration terminal, a mobile device, a third-party repository, or the like.

At 440, the security information can be transmitted, by the registration terminal, to the vault management system 310. The transmission of security information can be over a wired or wireless network, for example, LAN, WLAN, WI-FI, BLUETOOTH, or the like.

At 450, the vault management system 310 can associate the security information with a personal vault 150. This can occur as part of either a registration phase, for a first-time user, or an access phase for a user who has previously used the system. Further details regarding the registration and accessing of the system are described in greater detail in this FIG. 6, below.

Figure 5:
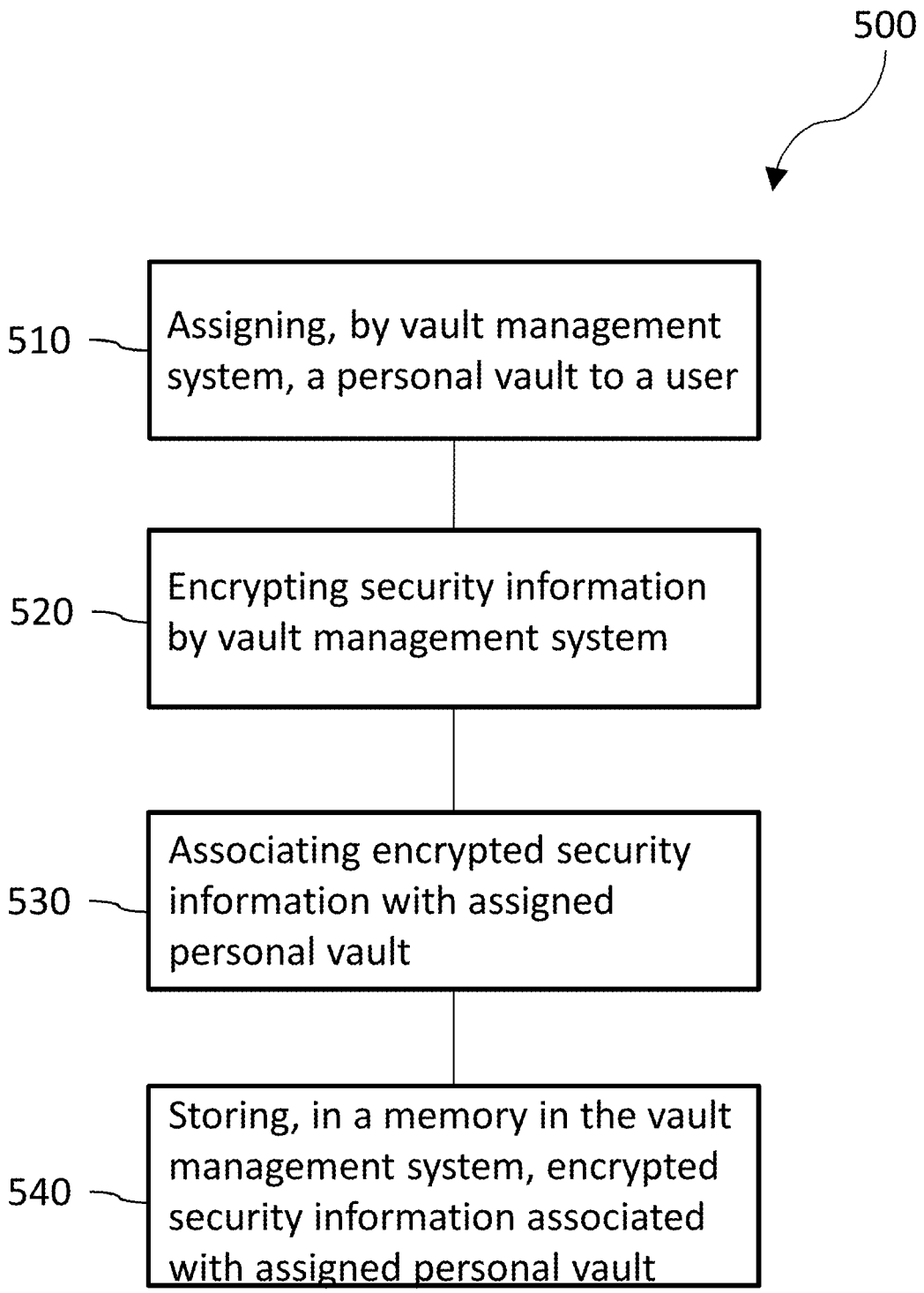
FIG. 5 is a process flow diagram illustrating the anonymous association of security information with the user by the vault management system.

FIG. 5 is a process flow diagram 500 illustrating the anonymous association of security information with the user by the vault management system 310. In some implementations, personal identifying information is not stored by the vault management system 310. In such implementations one or more features can be implemented to provide a way to associate a user with a personal vault 150 while maintaining the anonymity of the user to the owner and/or operator of the vault management system 310. For example, the unlocking of barriers, vault doors 142, or personal vaults 150 can be based on the vault management system 310 identifying an association between an anonymous user and the personal vault associated with the anonymous user. In making this association, the vault management system 310 does not identify the anonymous user, only matching the security information to the account of the anonymous user. Accordingly, the identification based on the security information that does not include personal identifying information for the anonymous user. Personal identifying information can include, for example, user names, social security numbers, credit card numbers, addresses, or the like.

At 510, a vault management system 310 can assign a personal vault 150 to a user. In some implementations, this can be a continuation of the process described in FIG. 4, detailed above. The vault management system 310 can access, in a database or other computer program, an inventory of available personal vaults 150 to determine which personal vault 150 is assigned to the user.

At 520, the security information received by the registration terminal can be encrypted by the vault management system 310. Encryption can include, for example, public key encryption, private key encryption, symmetric key encryption, or the like.

At 530, encrypted security information can be associated with the assigned personal vault 150. The association, in one implementation, can be made on the basis of only the assignment by the vault management system 310 in the encrypted security information, and not based on any personal identifying information of the user.

At 540, encrypted security information associated with the assigned personal vault 150 can be stored in a memory 330 of the vault management system 310. The memory 330 can be for example, a database, hard drive, distributed memory 330 systems, or the like. The vault management system 310 can then access the encrypted security information, to verify, without knowing the identity of the user, that the user requesting access to a personal vault 150 is the same as the user that was originally assigned to the personal vault 150.

Figure 6:
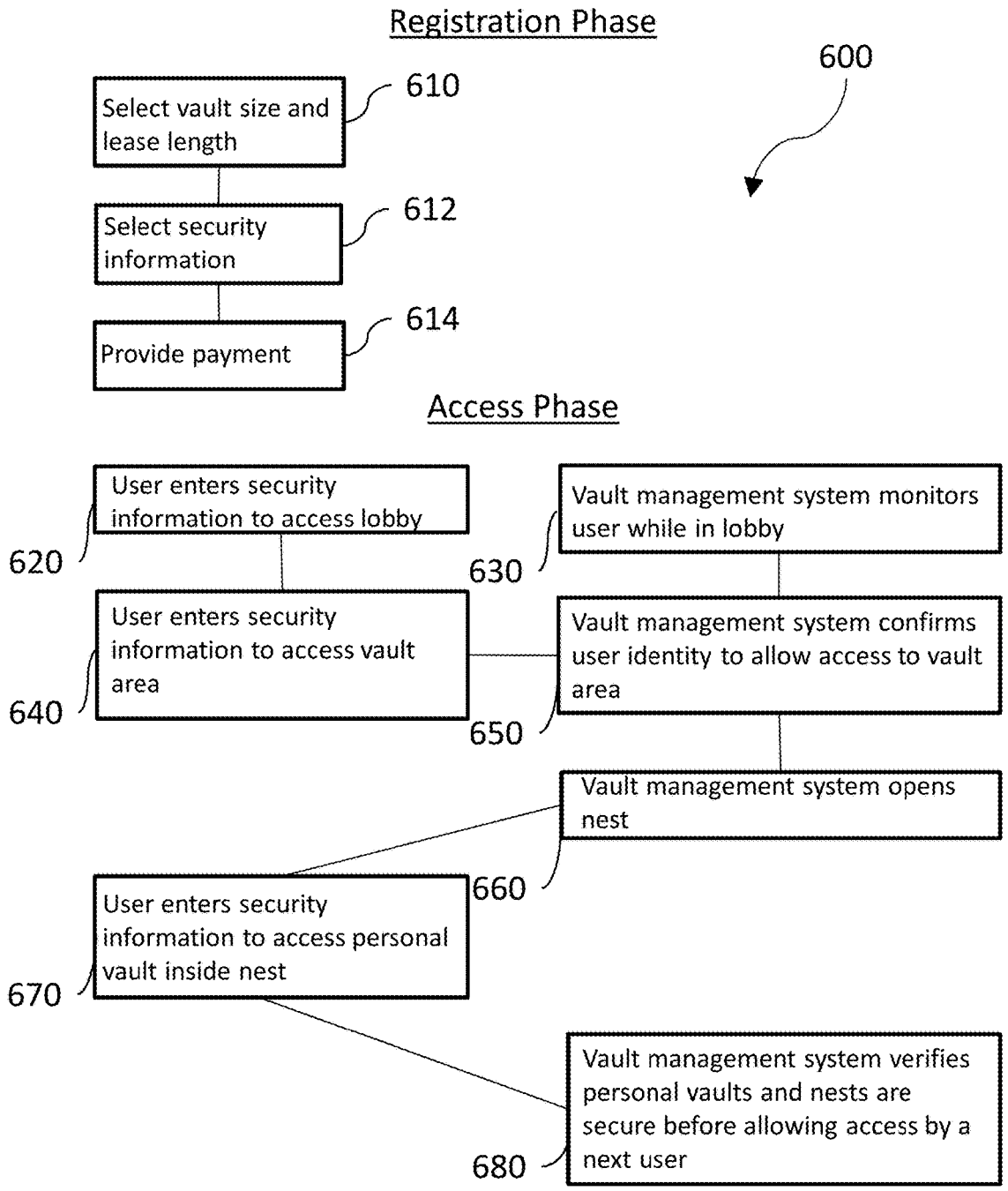
FIG. 6 is a process flow diagram illustrating a user accessing a personal vault.

FIG. 6 is a process flow diagram 600 illustrating a user accessing a personal vault 150. As shown in FIG. 6, and described above in relation to FIG. 4, there can be registration phase for a first-time user and an access phase for users who already have a personal vault 150 assigned to them.

In one exemplary implementation, the registration phase can include, at 610, selecting of size of the personal vault 150, or any additional features included therewith. Additional features can include, physical dimensions, location, size of the nest 140 associated with the personal vault 150, degree of security included with the personal vault 150, or the like. In another implementation, the user account can be set up before hand on a website, through a mobile device, or the like. Once set up over the Internet, the user can receive a code to allow access to the vault area 130 and/or their personal vault 150.

Several features can be offered to provide the user with additional services. For example, the user can be offered a photo backup system. The photo backup system can include a thumb drive or flash drive that can allow the user to back up all photos and store the thumb drive in the personal vault 150. Another feature can include the obtaining of additional insurance for the goods stored in the personal vault. Yet another feature can include the obtaining of a home inventory system stored on a thumb drive. The home inventory system can include information on items in their home, including serial numbers, documents, photos, a list of all items, and the like. The thumb drive can then be stored in the personal vault 150. A further feature can be purchasing estate planning in the event that the owner of the account passes.

At 612, security information can be entered by the user at the registration terminal or at another terminal, for example in the entrance area 122. Security information can include, for example, any of the combination of codes and/or biometrics described above.

At 614, payment can be provided to finalize the registration of a personal vault 150 to the user.

The access phase can be substantially similar for both first-time users and subsequent users with differences in the process noted herein. At 620, once a personal vault 150 has been assigned to a user, the user can enter security information to access the entrance area 122. Security information can be entered at any terminal interface, including the registration terminal, and transmitted to the vault management system 310. In the case of a first-time user, in one implementation, the registration process may be sufficient to grant access to the entrance area 122.

In some implementations, the registration terminal can be outside the entrance area 122 thus allowing only registered users to have access to the terminal area 122. In one implementation, the system can require that only one user is allowed access to the vault area 130 at a time. In this implementation, other registered users can wait in the secured environment of the entrance area 122 outside the vault area 130. In the entrance area 122 there can be a terminal interface which can be used to allow access to the vault area 130. As used herein, the granting of access to a user can include unlocking any of the barriers to the entrance area 122, vault area 130, the nests 140, or the personal vaults 150.

In one embodiment, when a first-time user signs up, a welcome package or other information can be in the personal vault 150. The welcome package can include terms and conditions, a key or FOB, instructions, a welcome gift, and the like. Alternatively, the terms and conditions for use can be show to the user when the user registers at the terminal. Vault personnel can regularly inspect the personal vaults to make sure each non-assigned personal vault has a welcome package, such that when a user does obtain that personal vault, the package is there.

At 630, in one exemplary implementation, the vault management system 310 can monitor the user while in the terminal area 120. In addition to providing general security, the monitoring by the vault management system 310 can ensure that only one user at a time is allowed to access the vault area 130 as described in later steps. The monitoring can include detecting, based on monitoring data received at the vault management system 130, that there is a user in the terminal area 120 or in the entrance area 122. A visual verification can be performed to determine that user being monitored corresponds to the security information entered by the user. Access to the vault area 130 can be granted by unlocking the vault door when the user has passed the visual verification.

At 640, a user can enter security information to access the vault area 130. The security information to access the vault area 130 can include, for example, any of the security information taken by the vault management system 310 during the registration phase.

At 650, after entering the security information as in 640, the vault management system 310 can confirm the user identity to allow access to the vault area 130. Confirmation can include accessing the encrypted security information provided by the user and stored by the vault management system 310. Also, there can be a separate check against the user's account information. For example, if it is determined by the vault management system 310 that the user's account is delinquent, then access to the vault area 130 can be denied. Allowing access can include unlocking a barrier to the vault area 130 when the security information received at the vault management system 130 matches stored security information.

At 660, after a user has been allowed access to the vault area 130, and contingent upon additional verification by the vault management system 310 of the user properly desiring access to a personal vault 150, the vault management system 310 can allow access to the nest 140 associated with the user. In one exemplary implementation, the additional verification can include a visual inspection of the user by the vault management system 310, for example, comparing photographs, still images, or video, of the user to a known profile. The visual inspection can be implemented by additional monitoring devices located within the vault area 130. The monitoring devices can transmit the monitoring data to the vault management system 310 for visual verification by the vault management system or an employee.

The vault door 142 can also be unlocked in response to receiving confirmation, at the server, that the user is the only user in the vault area. This can confirm that that user, and only that user, is the one requesting access to the personal vault 150.

In another exemplary implementation, the nest 140 can be opened only as a result of successful verification of a user's security information, and not by staff or other personnel connected with the vault management system 310. The vault management system 130 can determine which nest door 142 is associated with the user based on comparing the security information and monitoring data with records, accounts, or the like, stored at the vault management system. The vault management system can transmit a command to the nest door to unlock and allow user access to the personal vaults 150 in that nest 140. The other nest doors 142 not associated with the user can maintain a locked status.

At 670, after the nest 140 has been opened by the vault management system 310, the user can enter security information to access the personal vault 150 inside the nest 140. In one implementation, a unique physical key or FOB can be required to allow access to the personal vault 150. In some implementations, there can be an additional room or other enclosure that is not viewable or otherwise monitored. The user can take the contents of their personal vault 150 to this private room if they so wish.

At 680, after the user has completed their desired activities in the vault area 130, the vault area 130 can be accessed by another user. However, in one exemplary implementation, the vault management system 310 can verify that all personal vaults 150 and all nests 140 are secure and locked before allowing access by another user. This can include receiving, at the vault management system 310, a locked or unlocked status for any or all of the personal vaults and any or all of each nest. If either the personal vault 150 or a nest 140 is unable to be secured, an alert can be transmitted by the vault management system 310 to have appropriate personnel secure the site prior to allowing next use.

In another implementation, the monitoring devices 320, in conjunction with the vault management system 310, can monitor the terminal area 120 and or the area surrounding the vault enclosure 110 for threats to the user and/or the building. This can include monitoring, with the monitoring devices 320, the area external to the vault area 130 (which can include the terminal area 120 or the area outside the vault enclosure 110), for other persons besides the user. An alert device, for example a light, alarm, or the like, can be activated in the vault area 130 or terminal area 120 when the monitoring device detects users in an area external to the vault area 130.

In the event that suspicious activity is detected, the vault management system 310 can alert the user before the user exits the vault enclosure 110. The alert can include, for example, a computerized message, and audio alert through a loudspeaker, the visual alert on a screen or monitor, an alarm, or the like. In another implementation, the alarm triggered by any of the security systems in the vault area can include an audible sensory deprivation alarm. The audible sensory deprivation alarm can be an audio and/or visual alarm of sufficient intensity as to disable and or greatly interfere with the activities of an unauthorized person in the vault area.

In one implementation, there can be a multi-tiered account structure for users of the system. For example, there can be a basic account and an anonymous account. The basic account is intentionally not anonymous. This may be desirable for some users who do not desire nor need the risk associated with an anonymous account as described below. Both types of accounts can include any of the verification measures described above, also including a unique physical key or FOB which can be provided to the user upon registration. The unique physical key or FOB can be used in place of an alphanumeric code in the event that the user does not wish to or is unable to remember the alphanumeric code to their personal vault 150.

In contrast, the anonymous account, which provides the benefit of increased anonymity to user, by necessity has fewer options for verifying that a personal vault 150 is indeed associated with a particular user. In this implementation, because the security system to access the personal vault 150 of the user is a combination of multiple types of security, should the anonymous user forget or lose their alphanumeric code they may be unable to access their personal vault 150. Because, in this implementation, the identity of the user is not known even to the vault management system 310, the vault management system 310 would have no way of verifying the user's identity to allow access. In another implementation, in such an eventuality, the vault management system 310, at the end of a paid account period, can open the personal vault 150 to the personnel associated with the vault management system 310. In another implementation the vault management system 310 can issue an identification card or other identifying item which can be stored in the personal vault 150 of the anonymous user. The identification card can include an email, phone number, address or the like. In another embodiment, the identification card can be someone different from the user, but whom the user desires the contents of the personal vault to be sent (such as upon death, failure to pay, or the like). In this way, at the end of a paid account period, management personnel would be able to access the personal vault 150, see the identification card, and then return the items in the personal vault 150 to the user associated with the identification card.

In another embodiment, the anonymous user can associate an anonymous email address with the account, for example to be notified if a payment was due and outstanding.

Figure 7:
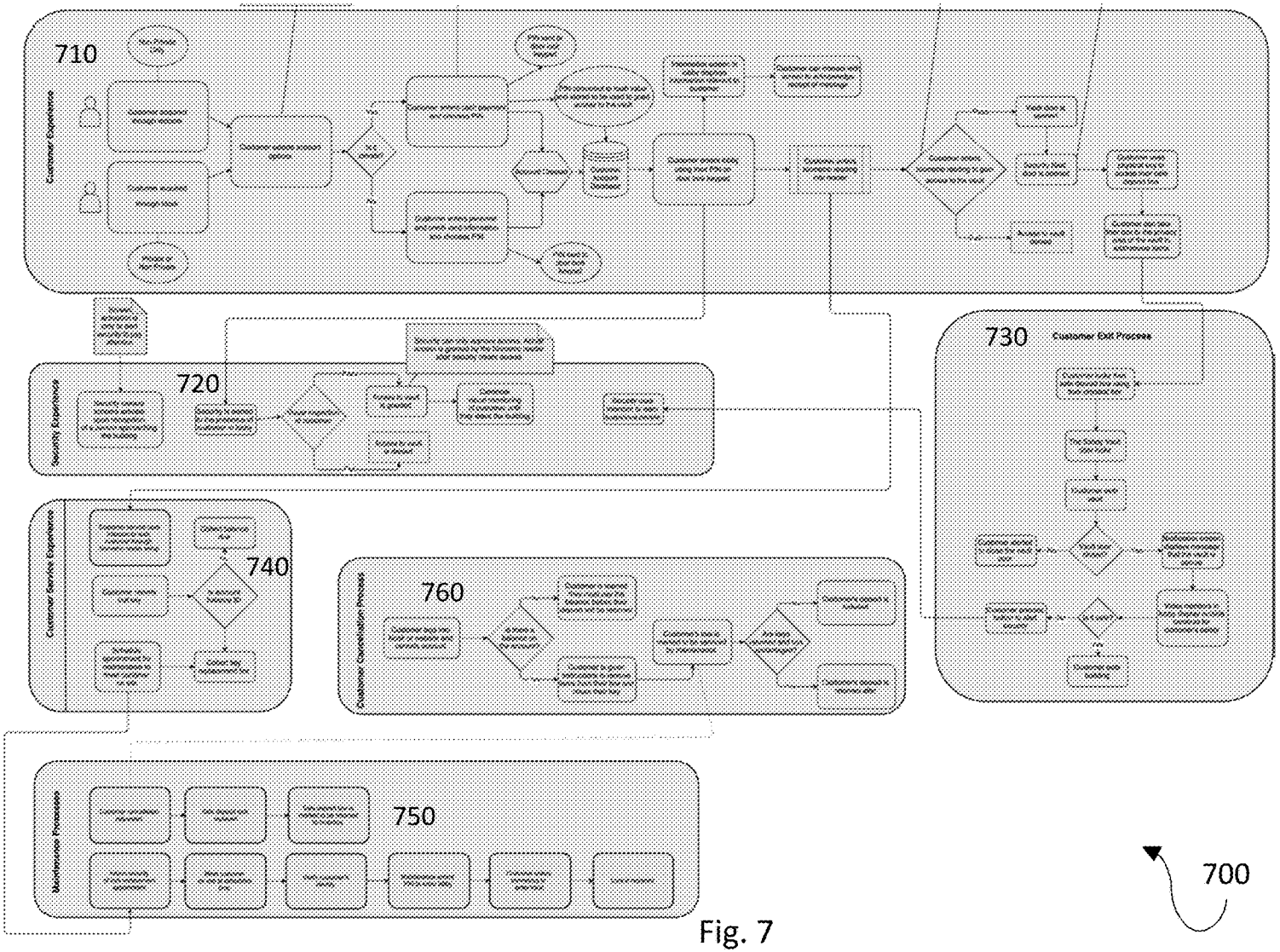
FIG. 7 is a process flow diagram illustrating various processes performed by the customer and/or the vault management system.

FIG. 7 is a process flow diagram 700 illustrating various processes performed by the customer and/or the vault management system 310. An integrated process describing the flow of actions taken by a customer and/or the vault management system 310 is shown. The illustrated processes are similar to those described in FIGS. 1-6. Processes described include a customer experience 710, where the user registers with the vault management system 310 and gains access to a personal vault 150, a security experience 720 describing the actions taken by the vault management system 310 to ensure the user's security while accessing their personal vault 150, a customer exit process 730 describing a user securing their personal vault 150 and safely exiting the area, a customer service experience 740 describing features that can aid a user in accessing their personal vault 150, a maintenance process 750 describing the maintenance of personal vaults 150 and the replacement of physical keys or FOB for a user that has either lost their physical key or FOB, or has canceled their relationship with the system, and a customer cancellation process 760 describing the customer terminating the relationship with the system.

Figure 8:
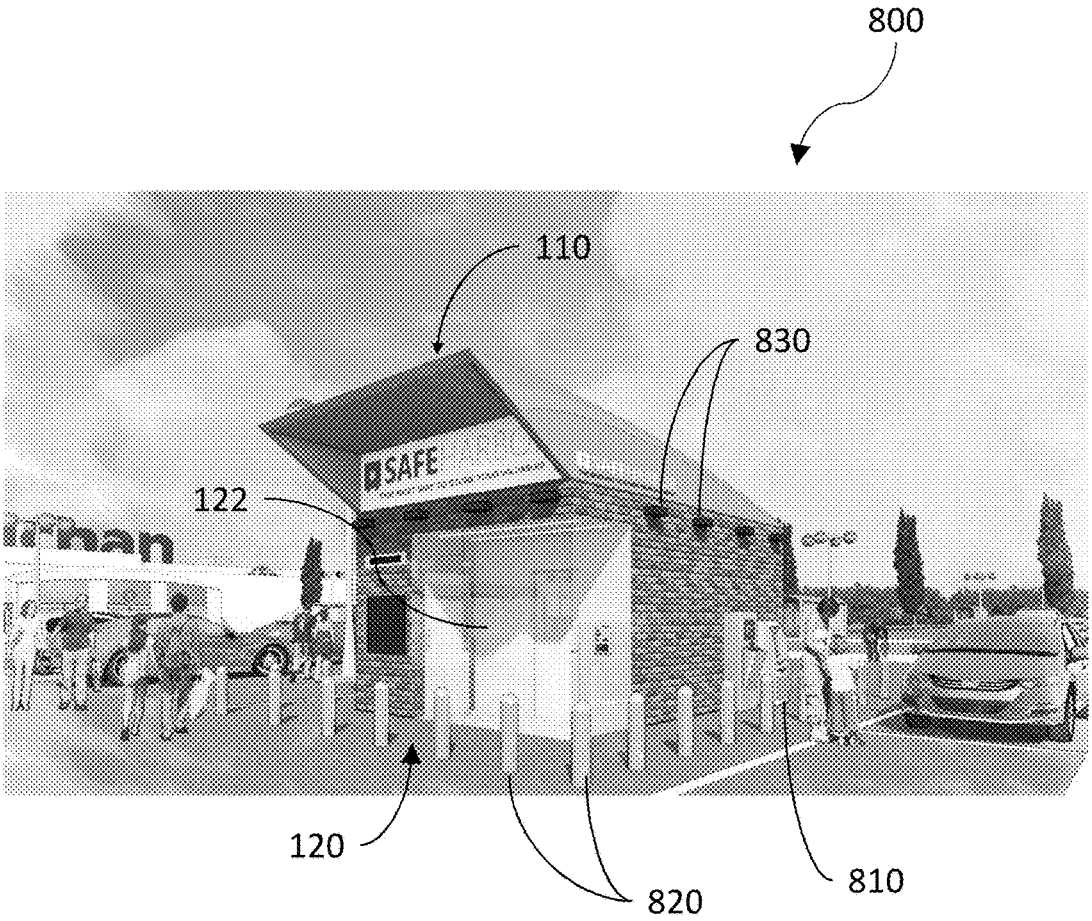
FIG. 8 is a diagram of an exemplary implementation illustrating external security features of the vault enclosure.

FIG. 8 is a diagram 800 of an exemplary implementation illustrating external security features of the vault enclosure 110. In addition to the numerous security measures described herein, there can also be a multi-tiered external security solution. For example, the vault enclosure 110, the terminal area 120, and the registration kiosk 810 (shown here external to the vault enclosure) can be within a perimeter secured by any number or configuration of vehicle barriers 820. The vehicle barriers 820 can be, for example, concrete pylons, concrete planters, bollards, or the like. The vehicle barriers 820 can be used to, for example, block cars, provide reinforcement to protect against explosives, maintain the safety of users entering and exiting the vault enclosure 110, or the like.

There can also be any number of exterior lights 830 positioned in any manner around at least a portion of the exterior of the vault enclosure 110. There can also be external security cameras (not shown) to monitor one or more areas outside the vault enclosure 110 or of the vault enclosure 110 itself. The power system of the vault enclosure 110 can also be tied to a backup system, for example, a battery system, independent generator, or the like. Such a backup power system can provide power in case there is a loss of main power due to service, environmental damage, and tempted security breach, or the like. In another implementation, in the event of a power failure, a cellular signal can be used to keep at least one camera operational.

Passive security solutions can also be employed. In one implementation, the vault enclosure can be located in in a high visibility/high traffic area. Such a judicious choice of location makes the vault enclosure 110 a less attractive target to thieves by virtue of the increased likelihood of observation by the public and/or law enforcement. Also, locating the vault enclosure 110 in a high visibility/high traffic area can reduce the response time from law enforcement typically patrolling these areas.

In the event of any security breach, or suspected security breach, automatic lock-down procedures can be employed. For example, access can be denied to the terminal area 120, the vault area 130, the nests 140, the personal vaults 150, and the like. As described above, any automatic lock-down procedure can be combined with an alert to law enforcement and/or the vault management system 310.

Figure 9:
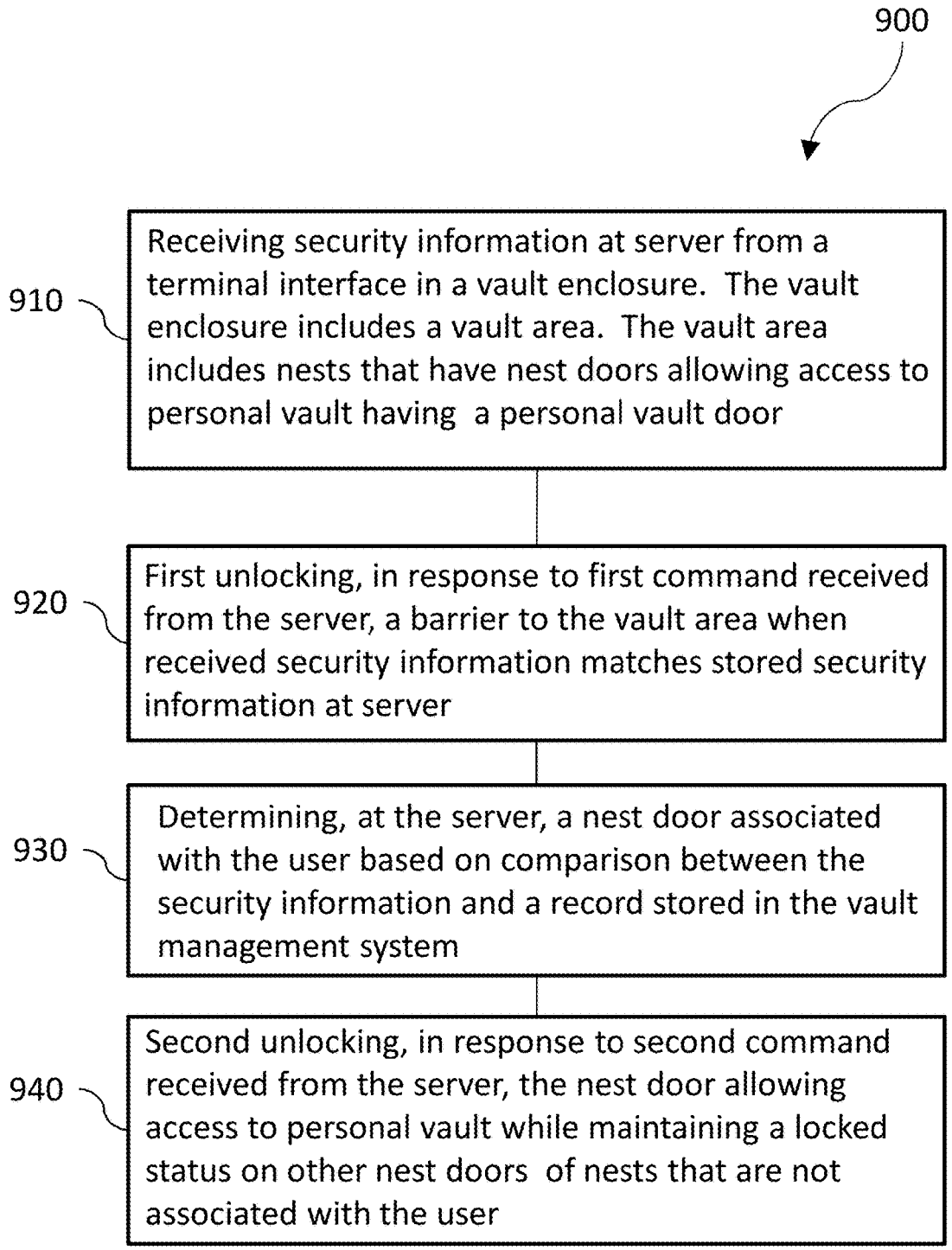
FIG. 9 is a diagram illustrating a method consistent with some implementations of the current subject matter.

FIG. 9 is a diagram 900 illustrating a method consistent with some implementations of the current subject matter.

At 910, security information can be received at a server from a terminal interface in a vault enclosure 110 comprising a vault area 130 and a terminal area 120, the vault area 130 including nests 140 with nest doors 142 allowing access to a personal vault 150 having a personal vault door.

At 920, in response to a first command received from the server, a barrier to the vault area 130 can be unlocked when the received security information matches stored security information at the server.

At 930, the server can determine a nest door associated with the user based on a comparison between the security information and a record stored in the vault management system.

At 940, in response to a second command received from the server, the nest door 142 allowing access to the personal vault 150 can be unlocked while maintaining a locked status on other nest doors 142 of the nests 140 that are not associated with the user.

Implementations of the current subject matter can include, but are not limited to, articles of manufacture (e.g. apparatuses, systems, or the like), methods of making or use, compositions of matter, or the like consistent with the descriptions provided herein.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. Other implementations may be within the scope of the following claims.

One or more aspects or features of the subject matter described herein may be realized in digital electronic circuitry, integrated circuitry, specially designed ASICs (application specific integrated circuits), computer hardware, firmware, software, and/or combinations thereof. These various implementations may include implementation in one or more computer programs that are executable and/or interpretable on a programmable system including at least one programmable processor, which may be special or general purpose, coupled to receive data and instructions from, and to transmit data and instructions to, a storage system, at least one input device (e.g., mouse, touch screen, or the like), and at least one output device.

These computer programs, which can also be referred to as programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" (sometimes referred to as a computer program product) refers to physically embodied apparatus and/or device, such as for example magnetic discs, optical disks, memory, and Programmable Logic Devices (PLDs), used to provide machine instructions and/or data to a programmable data processor, including a machine-readable medium that receives machine instructions as a machine-readable signal. The term "machine-readable signal" refers to any signal used to provide machine instructions and/or data to a programmable data processor. The machine-readable medium can store such machine instructions non-transitorily, such as for example as would a non-transient solid state memory or a magnetic hard drive or any equivalent storage medium. The machine-readable medium can alternatively or additionally store such machine instructions in a transient manner, such as for example as would a processor cache or other random access memory associated with one or more physical processor cores.

To provide for interaction with a user, the subject matter described herein can be implemented on a computer having a display device, such as for example a cathode ray tube (CRT) or a liquid crystal display (LCD) monitor for displaying information to the user and a keyboard and a pointing device, such as for example a mouse or a trackball, by which the user may provide input to the computer. Other kinds of devices can be used to provide for interaction with a user as well. For example, feedback provided to the user can be any form of sensory feedback, such as for example visual feedback, auditory feedback, or tactile feedback; and input from the user may be received in any form, including, but not limited to, acoustic, speech, or tactile input. Other possible input devices include, but are not limited to, touch screens or other touch-sensitive devices such as single or multi-point resistive or capacitive trackpads, voice recognition hardware and software, optical scanners, optical pointers, digital image capture devices and associated interpretation software, and the like.

The subject matter described herein may be implemented in a computing system that includes a back-end component (e.g., as a data server), or that includes a middleware component (e.g., an application server), or that includes a front-end component (e.g., a client computer having a graphical user interface or a Web browser through which a user may interact with an implementation of the subject matter described herein), or any combination of such back-end, middleware, or front-end components. The components of the system may be interconnected by any form or medium of digital data communication (e.g., a communication network). Examples of communication networks include a local area network ("LAN"), a wide area network ("WAN"), and the Internet.

Because of the high-level nature and complexity of the selections and methods described herein, including the multiple and varied combinations of different calculations, computations and selections, such selections and methods cannot be done in real time quickly or at all by a human. The processes described herein rely on the machines described herein.

The computing system may include clients and servers. A client and server are generally remote from each other and typically interact through a communication network. The relationship of client and server arises by virtue of computer programs running on the respective computers and having a client-server relationship to each other. Other implementations may be within the scope of the following claims.

What is claimed:

1. A method comprising:

receiving, by a server, security information provided by a user from a terminal interface in a vault enclosure comprising a vault area, the vault area comprising a plurality of nests having a plurality of nest doors, at least one nest of the plurality of nests comprising a plurality of vaults having a plurality of vault doors, a vault door of the plurality of vault doors configured to be used to access a particular vault of the plurality of vaults that is specific to the user;

first unlocking, by the server, a barrier to the vault area when the received security information matches stored security information that is stored at the server and is specific to the user, the server performing the first unlocking without identifying the user;

determining, at the server and based on a comparison between the security information and a record stored at the server, a nest door of a nest of the plurality of nests that has the particular vault; and second unlocking, by the server, the nest door to allow to the user access to the particular vault while maintaining a locked status on other nest doors of the plurality of nest doors, the server performing the second unlocking without identifying the user.

2. The method of claim 1, further comprising:

detecting, at the server, the user in an entrance area based on monitoring data transmitted from a monitoring device configured to monitor the entrance area;

determining, at the server, that the user passes visual verification based on a comparison between the monitoring data and the stored security information; and performing the first unlocking based on the user passing visual verification.

3. The method of claim 1, further comprising:

detecting, at the server, the user in the vault area based on second monitoring data transmitted from a second monitoring device configured to monitor the vault area;

receiving, at the server, a confirmation that the user is the only user in the vault area; and performing the second unlocking based on the received confirmation.

4. The method of claim 1, further comprising:

comparing, at the server, the second monitoring data to a known profile of the user to confirm identity of the user, the second monitoring data comprising at least one of images and video from the second monitoring device; and performing the second unlocking when the user identity is confirmed.

5. The method of claim 1, further comprising:

receiving, at the server, a status for each personal vault and each nest, the status indicating whether the personal vault is locked; and performing the first unlocking only when the status of each personal vault is locked and each nest is locked.

6. The method of claim 1, wherein the security information comprises at least one of a facial recognition scan, a fingerprint scan, or a voiceprint scan.

7. The method of claim 6, wherein at least one of the first unlocking and the second unlocking are based on the server identifying an association between an anonymous user and the particular personal vault associated with the anonymous user, the identification of the association based on the security information that excludes personal identifying information for the anonymous user.

8. The method of claim 1, further comprising:

monitoring, with an external monitoring device, a terminal area for one or more users other than the user; and activating an alert device in the vault area or in the terminal area when the monitoring device detects the one or more users other than the user in the terminal area.

9. A computer program product comprising a non-transient, machine-readable medium storing instructions which, when executed by at least one programmable processor, cause the at least one programmable processor to perform operations comprising:

receiving, at a server, security information from a terminal interface in a vault enclosure comprising a vault area, the vault area comprising a plurality of nests, the plurality of nests comprising a plurality of nest doors allowing access to a personal vault comprising a personal vault door;

first unlocking, in response to a first command received from the server, a barrier to the vault area when the received security information matches stored security information at the server;

determining, at the server, a nest door associated with a user based on a comparison between the security information and a record stored at the server; and second unlocking, in response to a second command received from the server, the nest door allowing access to the personal vault while maintaining a locked status on other nest doors of the plurality of nests that are not associated with the user, the first unlocking and the second unlocking being performed without identifying the user.

10. The computer program product of claim 9, further comprising:

detecting, at the server, the user in an entrance area based on monitoring data transmitted from a monitoring device configured to monitor the entrance area;

determining, at the server, that the user passes visual verification based on a comparison between the monitoring data and the security information stored at the server; and performing the first unlocking based on the user passing visual verification.

11. The computer program product of claim 9, further comprising:

detecting, at the server, the user in the vault area based on second monitoring data transmitted from a second monitoring device configured to monitor the vault area;

receiving, at the server, a confirmation that the user is the only user in the vault area; and performing the second unlocking based on the received confirmation.

12. The computer program product of claim 9, further comprising:

comparing, at the server, the second monitoring data to a known profile of the user to confirm a user identity, the second monitoring data comprising at least one of photographs, still images, or video from the second monitoring device; and performing the second unlocking when the user identity is confirmed.

13. The computer program product of claim 9, further comprising:

receiving, at the server, a status for each personal vault and each nest, the status indicating whether the personal vault is locked or unlocked; and performing the first unlocking only when the status of each personal vault is locked and each nest is locked.

14. The computer program product of claim 9, wherein the security information comprises a facial recognition scan, a fingerprint scan, or a voiceprint scan.

15. The computer program product of claim 14, wherein the first unlocking or the second unlocking is based on the server identifying an association between an anonymous user and the personal vault associated with the anonymous user, the identification based on the security information that does not include personal identifying information for the anonymous user.

16. The computer program product of claim 9, further comprising:

monitoring, with an external monitoring device, a terminal area to the vault area for users other than the user; and activating an alert device in the vault area or in the terminal area when the monitoring device detects users in the terminal area.

17. A vault enclosure comprising:

a vault area comprising:

a plurality of nests, the plurality of nests comprising a plurality of nest doors allowing access to a personal vault comprising a personal vault door, the nest door comprising a nest lock connected by a network connection to a server controlling a locking and unlocking of the nest lock, the locking and unlocking of the nest lock being performed without identifying the user;

a terminal area comprising:

a registration terminal connected by the network connection to the server and configured to receive security information from a user and transmit the security information to the server; and a barrier between the terminal area and the vault area, the barrier comprising a barrier lock connected by the network connection to the server controlling a locking and unlocking of the barrier lock, the locking and unlocking of the barrier lock being performed without identifying the user; and a monitoring device in the terminal area and configured to monitor the terminal area and transmit monitoring data to the server.

18. The vault enclosure of claim 17, wherein each of the plurality of nests comprises a plurality of personal vaults and each personal vault can be accessed by at most one nest door.

19. The vault enclosure of claim 17, wherein the vault enclosure is an isolated structure that has no walls, floors, or ceilings in contact with another building.

20. The vault enclosure of claim 17, wherein the vault enclosure is surrounded by the terminal area.

* * * * *